US005107557A

United States Patent [19]

Boyd

[11] Patent Number: 5,107,557

[45] Date of Patent: Apr. 28, 1992

[54] WATERBED MATTRESS WITH AIR CUSHION

[76] Inventor: Dennis Boyd, 14457 Rouge River, Chesterfield, Mo. 63017

[21] Appl. No.: 655,113

[22] Filed: Feb. 14, 1991

[51] Int. Cl.[5] ..... A47C 27/10

[52] U.S. Cl. ..... 5/451; 5/458; 5/455

[58] Field of Search ..... 5/450, 451, 455, 449, 5/422, 441, 458

[56] References Cited

U.S. PATENT DOCUMENTS

| | | | |
|---|---|---|---|
| 2,604,641 | 7/1952 | Reed | 5/455 |
| 4,149,541 | 4/1979 | Gammons et al. | 5/455 |
| 4,292,701 | 10/1981 | Woychick | 5/451 |
| 4,389,742 | 6/1983 | DeWitt | 5/451 |
| 4,724,560 | 2/1988 | Christie | 5/455 |
| 4,821,354 | 4/1989 | Little | 5/450 |
| 4,901,386 | 2/1990 | Lane | 5/450 |
| 5,044,030 | 9/1991 | Balaton | 5/451 |

FOREIGN PATENT DOCUMENTS

| | | | |
|---|---|---|---|
| 608951 | 2/1979 | Switzerland | 5/451 |

*Primary Examiner*—Alexander Grosz
*Attorney, Agent, or Firm*—Polster, Lieder, Woodruff and Lucchesi

[57] ABSTRACT

A waterbed mattress includes a vinyl watertight water bladder covered by an inflatable air cushion. In one embodiment, the top of the bladder forms the bottom surface of the air cushion, although the bottom surface of the air cushion may also be a separate sheet of vinyl. In either event, the air cushion is composed of two layers of vinyl, sealed around the edges. These layers are also sealed together at a number of locations inside the periphery of the air cushion and the air cushion is partially inflated to give the top of the mattress a soft, pillowy appearance. The air cushion layers are optionally sealed together to form separate zones which may be inflated varying amounts. Although it is preferred that the zones be inflated with air, some of the zones can be filled with water instead. The seals in the air cushion define numerous paths for air to flow under the user. When inflated a sufficient amount, the air cushion provides an insulating layer between the bladder of the waterbed mattress and the user. In addition to the air cushion, the mattress may further include an inflatable air bladder, either inside the vinyl bladder of the waterbed mattress or between the air cushion and the vinyl bladder, to provide additional support in predetermined areas, such as the lumbar area. An inflation valve for the watertight bladder passes through the air cushion and the air cushion is completely sealed circumferentially about the inflation valve.

10 Claims, 5 Drawing Sheets

WATERBED MATTRESS WITH AIR CUSHION

BACKGROUND OF THE INVENTION

This invention relates generally to waterbed mattresses and more particularly to a waterbed mattress with an air cushion top.

The advantages and benefits of waterbeds over conventional beds is well-known. There have, however, heretofore been some perceived disadvantages of waterbed mattresses which have reduced the acceptance of waterbeds. For example, many waterbed mattresses heretofore have been constructed with a flat, upper surface made of a single sheet of vinyl. This single sheet tended to conform closely to the body of the user so that it sometimes became difficult for the user's skin to breathe. Perspiration often resulted.

Furthermore, since water is a fairly good conductor or heat, it has proved desirable with standard waterbed mattresses to have a heater to keep the water in the mattress at a suitably high temperature compatible with the needs of a human body. Otherwise, the unheated mattress tended to conduct so much heat away from the human body that the user became uncomfortable.

The standard waterbed mattress also could be improved in appearance. The single vinyl top sheet of these mattresses is rather plain and flat in appearance, even with a pattern embossed thereon. Conventional mattresses, on the other hand, traditionally have a tufted or quilted appearance which people find attractive.

Most waterbed mattresses can be adjusted in firmness by adjusting the amount of water in the mattress bladder. But this firmness is the same throughout the mattress. It would be desirable to be able to adjust the comfort of various zones of the mattress, such as the head zone and the lumbar zone, to accommodate the preferences of various users. Moreover, adjusting the amount of water in a waterbed mattress is not a trivial matter. Typically it requires the use of hoses and a ready supply of water.

SUMMARY OF THE INVENTION

Among the various objects and features of the present invention may be noted the provision of an improved waterbed mattress in which the comfort and firmness may be readily and simply adjusted without the possibility of spilling any water.

Another object is the provision of such a waterbed mattress which provides an air flow underneath the user so that the user's skin can breathe and undue perspiration does not develop.

A third object is the provision of such a waterbed mattress which in some embodiments eliminates the need for a heater.

A fourth object is the provision of such a waterbed mattress with an improved appearance.

A fifth object is the provision of such a waterbed mattress with separately adjustable zones.

A sixth object is the provision of such a waterbed mattress with increased versatility.

Other objects and features will be in part apparent and in part pointed out hereinafter.

Briefly, in its broadest aspect a waterbed mattress of the present invention includes a vinyl watertight bladder for holding water, which watertight bladder has a top, a bottom, and sides when filled with water, and an inflatable air cushion disposed on the top of the vinyl watertight bladder and secured thereto. The air cushion extends generally the length and breadth of the top of the vinyl watertight bladder.

BRIEF DESCRIPTION OF THE DRAWINGS

Similar reference characters indicate similar parts throughout the several views of the drawings.

DESCRIPTION OF THE PREFERRED EMBODIMENT

Figure 1:
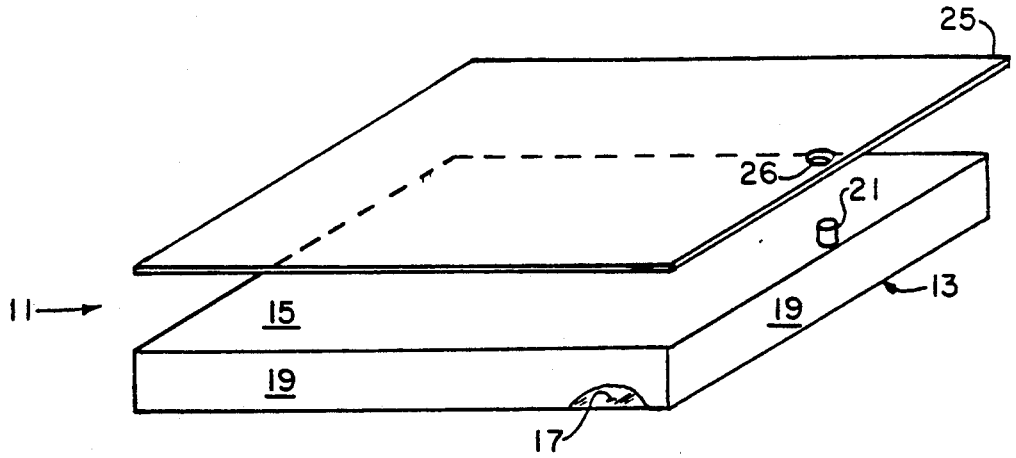
FIG. 1 is an exploded perspective view illustrating the construction of the waterbed mattress of the present invention.
Figure 2:
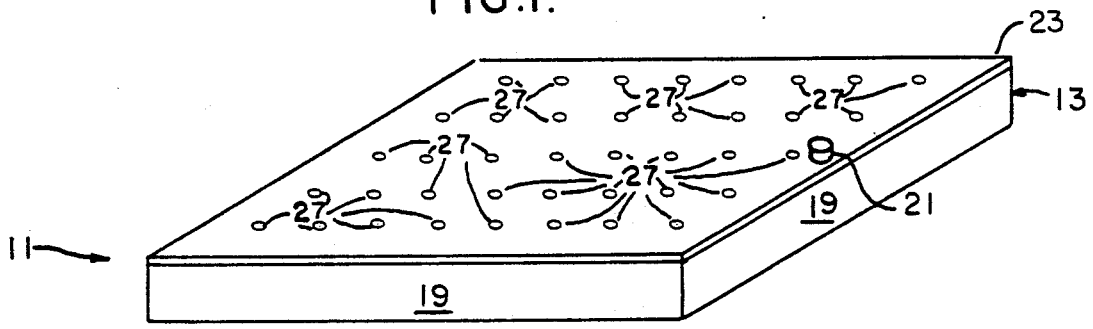
FIG. 2 is a perspective view of the waterbed mattress of FIG. 1.

Turning to the drawings and more specifically to FIGS. 1 and 2, a waterbed mattress 11 of the present invention includes a vinyl watertight bladder 13 for holding water. Except as noted below, bladder 13 is of standard waterbed mattress construction. The watertight bladder 13 has a top 15, a bottom 17, and sides 19 when filled with water through a water inflation valve 21 (valve 21 is also of standard construction).

The mattress also includes an inflatable air cushion 23 disposed on the top 15 of bladder 13. Air cushion 23 is formed in combination with top 15 by a single sheet 25 of vinyl which is secured to top 15 by radio frequency sealing completely around the periphery of the air cushion (Alternatively, air cushion 23 is formed from two separate sheets of vinyl ) Since sheet 25 is substantially the same length and breadth as bladder 13, this forms an airtight air cushion covering the entire top of the waterbed mattress Sheet 25 includes an orifice 26 for accommodating the bladder inflation valve 21.

Thus, the air cushion 23 is formed of two layers, one of which is optionally top 15 of bladder 13.

Figure 3:
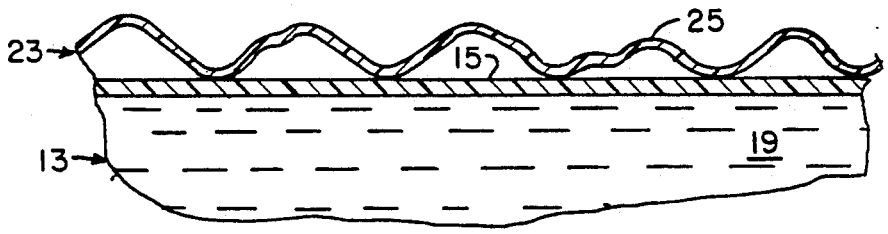
FIG. 3 is a sectional elevation, on an enlarged scale with parts broken for clarity, of the waterbed mattress of FIG. 1.

In addition to the peripheral seal, vinyl sheet 25 is sealed to bladder top 15 at a plurality of locations 27 inside the periphery of the air cushion. These seals 27 do not divide the air cushion into separate airtight regions, but instead merely tack down sheet 25 to bladder top 15 at a plurality of locations. Although these seals are shown in FIG. 2 as having a circular shape, other shapes, such as "diamond" shapes, are also acceptable. As can be seen more clearly in FIG. 3, when air cushion 23 is partially inflated with air, this tacked construction results in a soft, pillow-like or tufted appearance for the waterbed mattress as a whole. Because the air cushion is only partially inflated, vinyl sheet 25 between tacks is uneven, which provides a very soft "look" to mattress 11. This appearance is greatly superior to that of a plain vinyl sheet, yet is achieved merely with only two sheets of vinyl and air.

Figure 4:
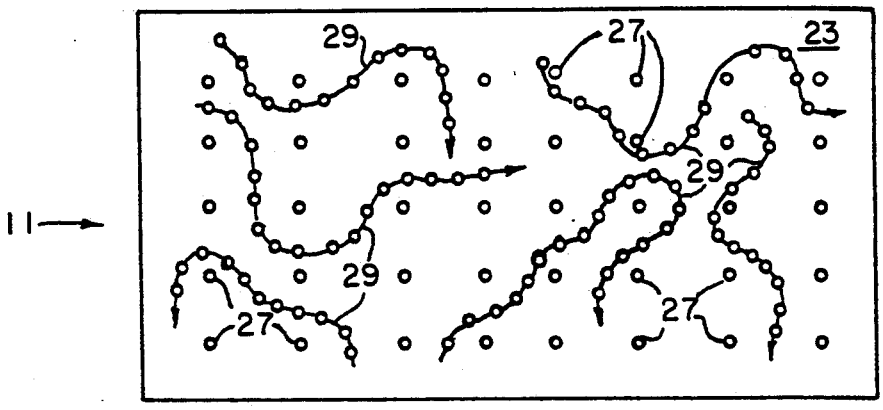
FIG. 4 is a top plan of the waterbed mattress of FIG. 1.

In addition to providing a pleasing appearance, seals 27 provide a plurality of paths 29 (FIG. 4) for the movement of air from place to place in the air cushion.

In addition to the seals mentioned above, mattress 11 may have additional seals (such as seal 33 and seals 35 and 37 shown in FIG. 5) which divide air cushion 23 into separate, individually airtight zones, each with its own air inflation valve 39. Seal 33, which extends longitudinally the length of mattress 11, divides air cushion 23 into two completely separated zones 41, 43. This "his and her" construction is especially desirable since it efficiently provides the capability of individual comfort adjustment for both users of a regular size bed.

Figure 5:
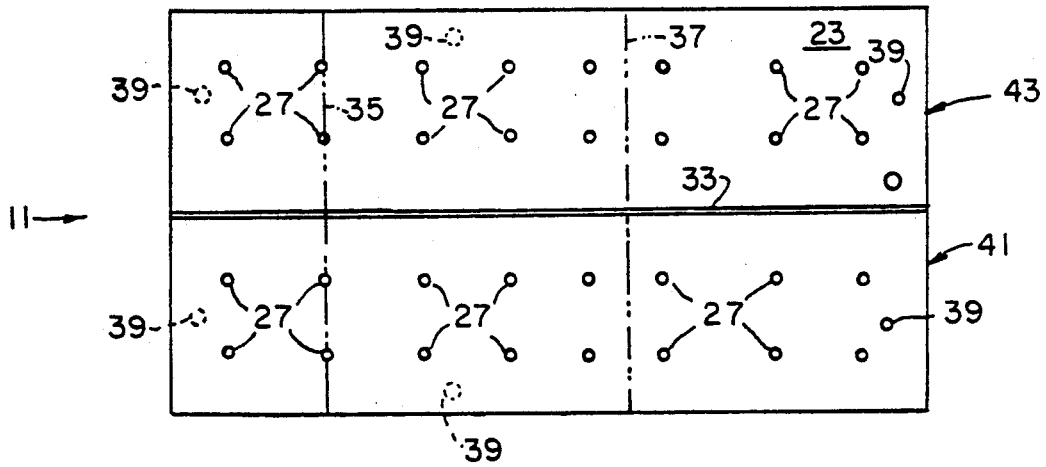
FIG. 5 is a top plan of an alternative embodiment of the waterbed mattress of FIG. 1.

Seals 35 and 37 (shown in phantom) can be added to further subdivide each side of the mattress of FIG. 5 into a head zone, a lumbar zone, and a foot zone. None that subdividing the mattress in this way allows for individual adjustment of the firmness of each zone without requiring any additional material other than the inflation valves 39 for each zone.

Figure 6:
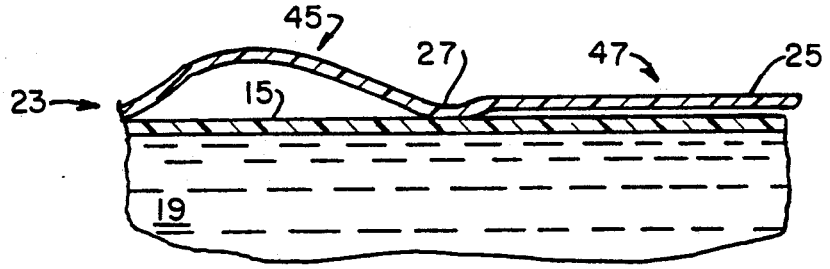
FIG. 6 a sectional elevation, on an enlarged scale with parts broken away for clarity, of the waterbed mattress of FIG. 1, illustrating one possible configuration of the mattress.
Figure 7:
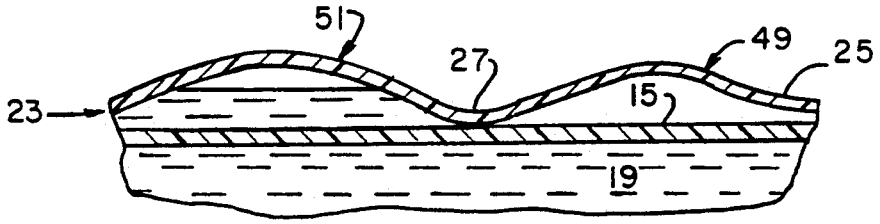
FIG. 7 is a sectional elevation similar to FIG. 6 illustrating second possible configuration of the mattress.

Use of the zone construction of FIG. 5 provides tremendous versatility to mattress 11. For example, in FIG. 6, one of the zones, labelled 45 is at least partially inflated while another zone 47 is completely deflated. In FIG. 7, one of the zones, labelled 49 is at least partially filled with air and another zone 51 is at least partially filled with water. It should be appreciated that these differences in inflation result in dramatic differences in the "feel" of mattress 11 from zone to zone, as desired by the user.

It should also be noted (see FIG. 8), that the structure of FIG. 1, with a multitude of seals 27, provide a plurality of air paths 53 beneath a user lying on the mattress 11. These paths are not available in standard waterbed mattresses, which tend to conform more closely to the body of the user. Paths 53 provide ventilation for the skin of the user and tend to reduce the possibility of perspiration.

Figure 8:
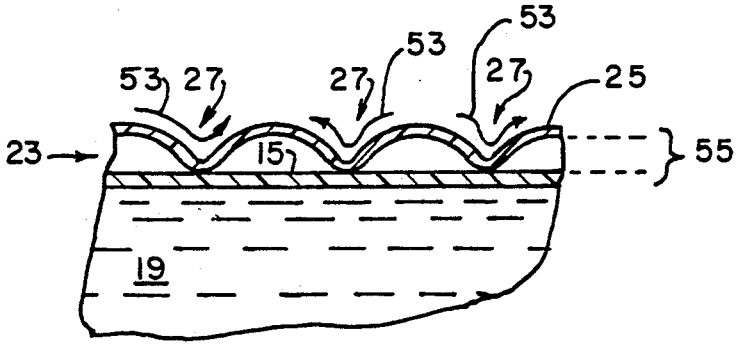
FIG. 8 is a sectional elevation similar to FIG. 6 illustrating the insulating layer effect in the mattress of the present invention.

Also shown in FIG. 8 is an insulating layer 55 formed by the air cushion between a user and bladder 13. This insulating layer is formed when the air cushion is inflated sufficiently to suspend the user away from the water bladder It greatly reduces the heat lost by the user's body due to conduction to the water in bladder 13. As a result no heater is needed in mattress 11 to keep the water at any particular temperature when air cushion 23 is sufficiently inflated.

Figure 9:
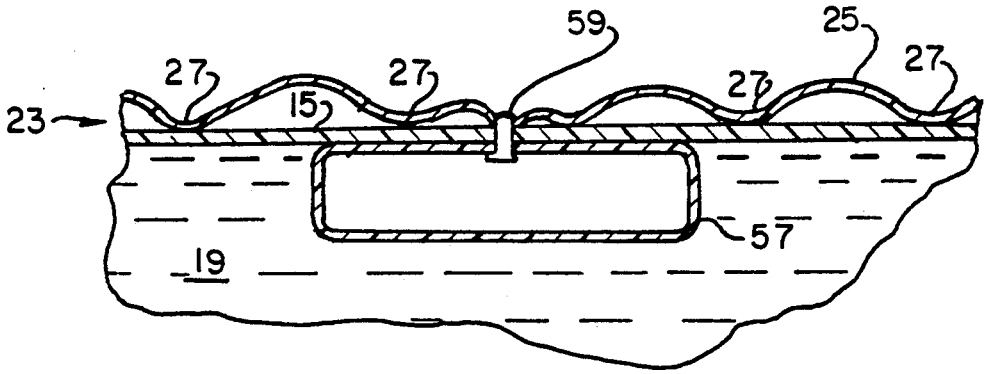
FIG. 9 is a sectional elevation, similar to FIG. 6, showing another alternative embodiment of the waterbed mattress of the present invention.

FIG. 9 illustrates yet another embodiment of mattress 11. In this embodiment, an air inflated bladder 57 is disposed inside vinyl bladder 13 to provide additional support in a predetermined area, such as the lumbar area. Bladder 57 is inflated to a desired firmness through an inflation valve 59 which extends through top 15 and air cushion 23. Air bladder 57 is fixed in position with respect to the vinyl watertight bladder by radio frequency sealing or the like. (See FIG. 12 for an alternative construction of a mattress with such an additional bladder.)

Figure 10:
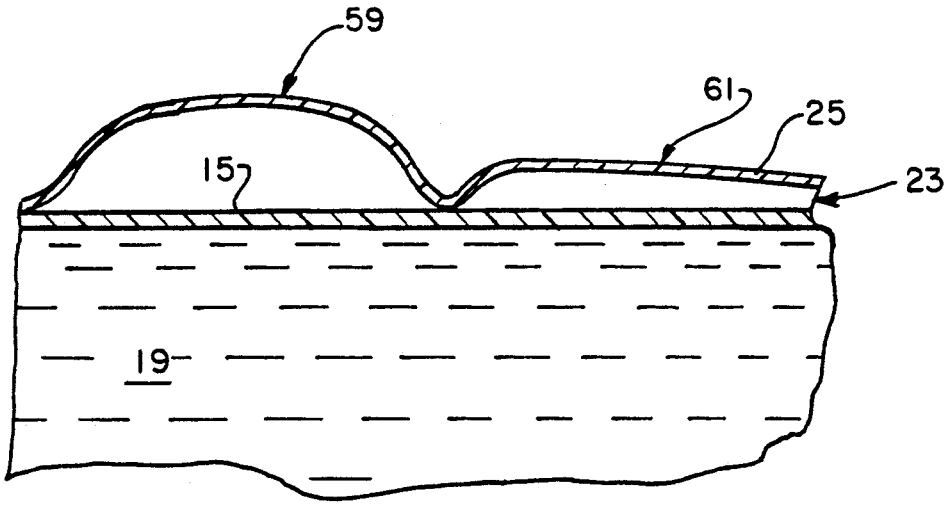
FIG. 10 is a sectional elevation, similar to FIG. 6, illustrating a third possible configuration of the mattress.

It is not necessary for the various zones of mattress 11 to all have the same height when fully inflated For example, in FIG. 10 a head zone 59 when fully inflated as shown is higher that a lumbar support zone 61. Although these maximum measures are set by the manufacture of mattress 11, the user can vary each downwardly to zero, if desired.

Figure 11:
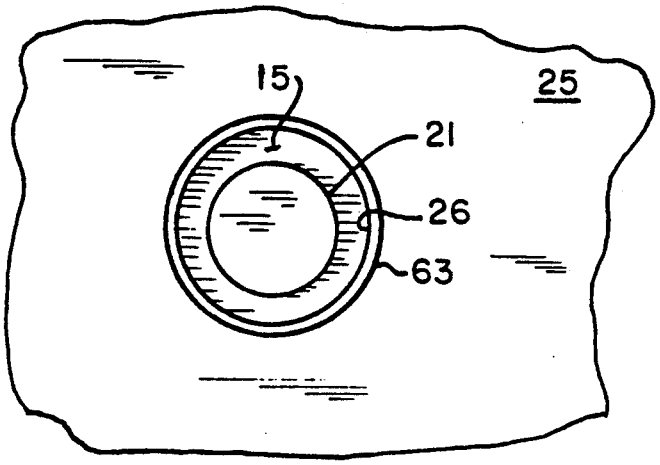
FIG. 11 is a top plan view, on an enlarged scale with parts broken away for clarity, of the mattress of FIG. 1.

Turning to FIG. 11, it can be seen that inflation valve 21 extends through orifice 26 in sheet 25. Sheet 25 is sealed by a radio frequency seal 63 which extends circumferentially about the inflation valve. This particular construction provides an airtight air cushion 23 while allowing easy access to inflation valve(s) 21.

Figure 12:
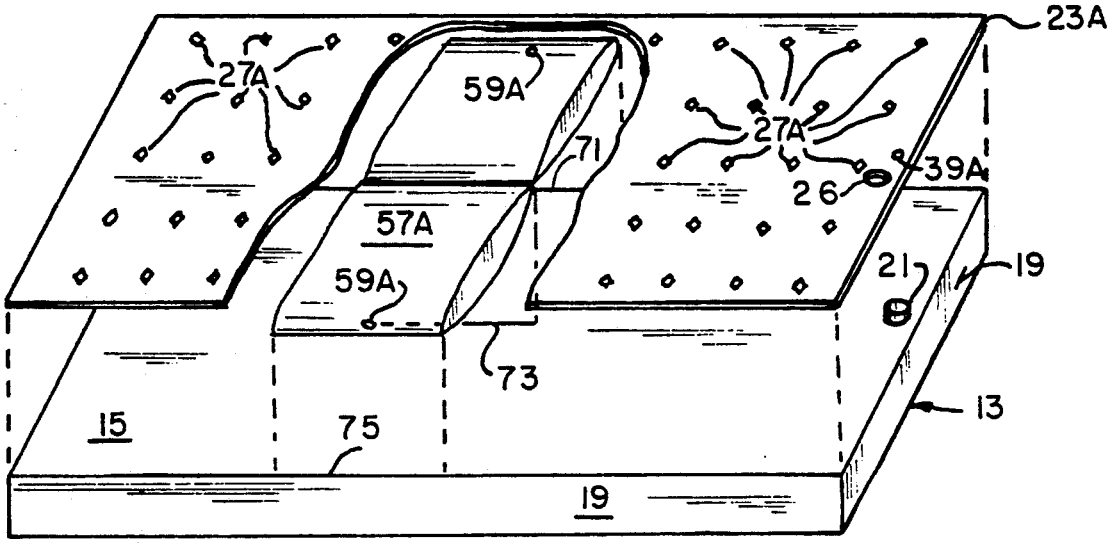
FIG. 12 is an exploded view, with parts broken away for clarity, of a further embodiment of the present invention.

Turning to FIG. 12, watertight water bladder 13 is shown in combination with an alternative lumbar support/air cushion construction. The air cushion 23A in this construction is made of two sheets of vinyl sealed together along the periphery and an numerous interior points 27A. Note that the interior seals 27A in this construction are diamond-shaped. A single air valve 39A (smaller in size than the water valve 21 of the watertight bladder so as to prevent confusion between the two) is disposed at the foot of air cushion 23A to allow the air cushion to be inflated the desired amount.

Disposed between the air cushion and the water bladder is a lumbar support 57A having a pair of inflation valves 59A. Lumbar support 57A is sealed to water bladder 13 along three lines 71, 73, 75, the middle of which seals separates the lumbar support into two independently inflatable portions Lumbar support, as shown, extends the entire width of the mattress.

Figure 13:
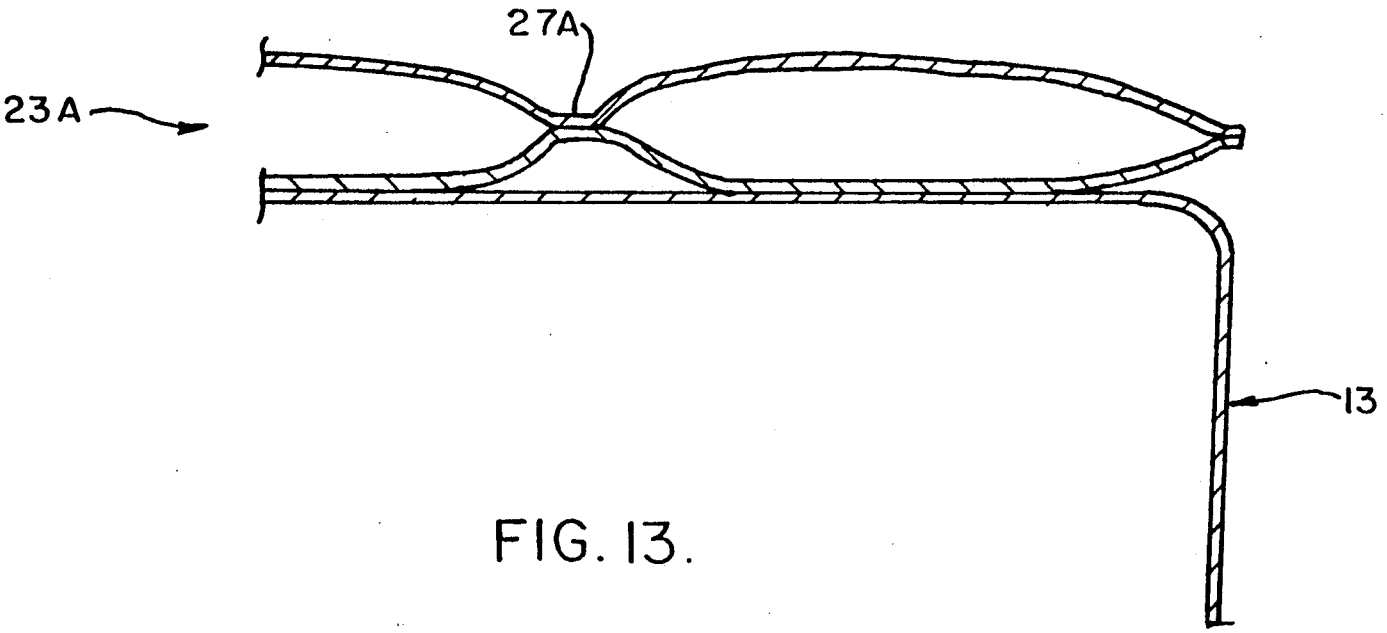
FIG. 13 is a sectional elevation, illustrating another possible configuration of the mattress of the present invention.

The embodiment shown in FIG. 13 is similar to those described above. It differs, however, in that the air cushion, labelled 23A, is composed of two layers of vinyl, sealed around the edges. Air cushion 23A is secured to the top of vinyl watertight bladder 13. The topmost layer of air cushion 23A is sealed to the other layer of the air cushion at a plurality of locations inside the periphery of the air cushion. One is shown as seal 27A in FIG. 13.

In view of the above it will be seen that the various objects and features of the invention are achieved and other advantageous results obtained The examples contained herein are merely illustrative and are not intended in a limiting sense.

What is claimed is:

1. A waterbed mattress comprising:

a vinyl watertight bladder for holding water, said watertight bladder having a top, a bottom, and sides when filled with water; and an inflatable air cushion disposed on the top of the vinyl watertight bladder and secured thereto, said air cushion extending generally the length and breadth of the top of the vinyl watertight bladder, said air cushion being of a size sufficient to totally support a supine user;

said air cushion being composed of at least two layers of vinyl, the topmost layer of the air cushion being sealed by relatively small, discontinuous seals to another layer of the air cushion at a plurality of locations inside the periphery of the air cushion, a relatively small fraction of the total area of the topmost layer of the air cushion being taken up by said small, discontinuous seals, said another layer of the air cushion being physically secured to the bottom of the watertight bladder only indirectly by means of the sides of the watertight bladder.

2. The waterbed mattress as set forth in claim 1 wherein said topmost layer and said another layer define a plurality of paths for the movement of air from place to place in the air cushion.

3. The waterbed mattress as set forth in claim 1 wherein said air cushion is composed of two layers of vinyl, sealed around the edges, said air cushion composed of two layers of vinyl being secured to the top of the vinyl watertight bladder.

4. A waterbed mattress comprising:

a vinyl watertight bladder for holding water, in said watertight bladder having a top, a bottom, and sides when filled with water; and an inflatable air cushion disposed on the top of the vinyl watertight bladder and secured thereto, said air cushion extending generally the length and breadth of the top of the vinyl watertight bladder, said air cushion being composed of at least two layers of vinyl, the topmost layer of the air cushion being sealed to another layer of the air cushion at a plurality of locations inside the periphery of the air cushion, said another layer of the air cushion being physically secured to the bottom of the watertight bladder only indirectly by means of the sides of the watertight bladder;

said air cushion being partially inflated an amount sufficient to give the top of the waterbed mattress a soft, pillow-like appearance and feel.

5. A waterbed mattress comprising:

a vinyl watertight bladder for holding water, said watertight bladder having a top, a bottom, and sides when filled with water; and an inflatable air cushion disposed on the top of the vinyl watertight bladder and secured thereto, said air cushion extending generally the length and breadth of the top of the vinyl watertight bladder, said air cushion being composed of at least two layers of vinyl, the topmost layer of the air cushion being sealed to another layer of the air cushion at a plurality of locations inside the periphery of the air cushion;

at least some of the seals being disposed to divide the air cushion into zones, at least some of the zones being completely separated from all other zones, further including a separate inflation valve for each completely separated zone.

6. The waterbed mattress as set forth in claim 5 wherein the seals divide the air cushion into two completely separated zones of substantially equal size disposed longitudinally of the waterbed mattress.

7. The waterbed mattress as set forth in claim 5 wherein at least one of the completely separated zones is at least partially inflated and at least one of the completely separated zones is completely deflated.

8. The waterbed mattress as set forth in claim 5 wherein at least one of the completely separated zones is at least partially inflated with air and at least one of the completely separated zones is at least partially filled with water.

9. A waterbed mattress comprising:

a vinyl watertight bladder for holding water, said watertight bladder having a top, a bottom, and sides when filled with water; and an inflatable air cushion disposed on the top of the vinyl watertight bladder and secured thereto, said air cushion extending generally the length and breadth of the top of the vinyl watertight bladder;

said air cushion being divided into independently inflatable zones.

10. The waterbed mattress as set forth in claim 9 wherein the height of the air cushion varies from zone to zone when the zones are fully inflated.

* * * * *